US009091515B1

(12) United States Patent
Lee

(10) Patent No.: US 9,091,515 B1
(45) Date of Patent: Jul. 28, 2015

(54) ARROWHEAD AND ARROW

(71) Applicant: Youngki Lee, Busan (KR)

(72) Inventor: Youngki Lee, Busan (KR)

( * ) Notice: Subject to any disclaimer, the term of this patent is extended or adjusted under 35 U.S.C. 154(b) by 0 days.

(21) Appl. No.: 14/158,814

(22) Filed: Jan. 18, 2014

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 4,973,060 | A | 11/1990 | Herzing | |
| 5,066,021 | A | 11/1991 | DeLucia | |
| 5,082,292 | A | 1/1992 | Puckett et al. | |
| 6,200,237 | B1 | 3/2001 | Barrie | |
| 6,258,000 | B1 | 7/2001 | Liechty, II | |
| 6,287,223 | B1 | 9/2001 | Liechty, II | |
| 6,669,586 | B2 | 12/2003 | Barrie et al. | |
| 8,062,155 | B2 | 11/2011 | Butcher | |
| 8,118,694 | B1 * | 2/2012 | Oliveira | 473/583 |
| 2013/0316861 | A1 * | 11/2013 | Lee | 473/583 |

* cited by examiner

*Primary Examiner* — John Ricci
(74) *Attorney, Agent, or Firm* — The PL Law Group, PLLC

(57) ABSTRACT

The present invention relates to an arrowhead and an arrow, and more particularly, to an arrowhead which enables a plurality of expanding blades to be rapidly and surely retracted or expanded without a separate binding means, and an arrow. According to embodiments of the present invention, since the plurality of expanding blades is adapted to be expanded at an entrance of a target at the same time when hitting the target, the plurality of expanding blades penetrates the target in an expanded state, and thus it is possible to induce excessive bleeding of game as the target.

9 Claims, 15 Drawing Sheets

ARROWHEAD AND ARROW

BACKGROUND

1. Field of the Invention

The present invention relates to an arrowhead and an arrow, and more particularly, to an arrowhead and an arrow including expanding blades.

2. Discussion of Related Art

Generally, an arrow is composed of a hollow arrow shaft, an arrowhead attached to a leading end of the arrow shaft, the nock of an arrow using which the arrow is fit in the string, and feathering for securing the flight stability of an arrow.

The arrowhead serves to pass through a target, so it should have excellent wear resistance and strength and it should have a structure enabling its flight to be stable, because upon hitting the target, the accumulated energy of an arrow is collected upon the arrowhead.

Generally, an arrowhead has a sharpened tip to improve penetration, but such a sharpened arrowhead is not practical for certain types of hunting. This is because it is difficult for the sharpened arrowhead to kill large game and thus gain control over the same. Thus, for this reason, a broad type arrowhead which has two to four sharp blades on its edge to induce profuse bleeding and the death of game may be used.

There is also disclosed a variety of arrowheads in which the blades are normally retracted inside the arrowhead and expand upon hitting a target because the blades of the broad type arrowhead affect the flight stability of an arrow.

Such blades having an expandable structure are referred to as expanding blades. A variety of conventional examples of arrowheads having such expanding blades are disclosed in U.S. Pat. No. 5,082,292 entitled "BROADHEAD WITH DEPLOYABLE CUTTING BLADES," U.S. Pat. No. 5,066,021 entitled "ARROW SYSTEM," U.S. Pat. No. 4,973,060 entitled "ARROHEAD WITH EXPANDABLE BLADES," U.S. Pat. No. 6,669,586 entitled "EXPANDING BROADHEAD," U.S. Pat. No. 6,258,000 entitled "PENETRATION ENHANCING AERODYNAMICALLY FAVORABLE ARROWHEAD," U.S. Pat. No. 6,287,223 entitled "DULLING PREVENTION FOR SHARP CUTTING EDGE OF BLADE-OPENING ARROWHEAD BLADES WHEN IN A CLOSED IN-FLIGHT POSITION," U.S. Pat. No. 8,062,155 entitled "ARROWHEAD HAVING BOTH FIXED AND MECHANICALLY EXPANDABLE BLADES," and U.S. Pat. No. 6,200,237 entitled "SLIDING BODY EXPANDING BROADHEAD," respectively.

All of the patent documents described above disclose an arrowhead having two to four expanding blades, in which, when an arrow hits a target, such as game, a plurality of expanding blades are expanded to enlarge and more deeply penetrate into the wound of the game, thereby enhancing the killing capability of the arrow.

However, such conventional expanding blades have a problem in that, when an arrow is flying after being shot, the expanding blades expand by themselves, thereby degrading the flight stability of the arrow and adversely affecting the hit rate and flight distance of the arrow.

Due to such a problem, in the case of an arrowhead having the conventional expanding blades, the plurality of expanding blades must be typically retracted and grouped together before an arrow is shot, and then be tied by a band or string which can be easily broken or slip off when the arrow hits the target.

In doing so, the expanding blades are maintained in a retracted state during flight of the arrow, but can be expanded by slipping-off of the band or string as soon as the arrow hits and penetrates into the target.

However, in such a manner in which the expanding blades should be retracted and then tied or bundled by the band and the like, there are inconveniences in that the retracted expanding blades must be bundled by the band and the like whenever an arrow is shot, and in turn the band must be always carried when hunting.

Therefore, there is a need to develop an arrowhead in which, during flight of an arrow, retracted expanding blades can be kept un-expanded to ensure the flight stability without using an additional means, and the expanding blades can automatically expand only when the arrow hits and penetrates into a target.

SUMMARY

One or more embodiments of the present invention is directed to provide an arrowhead and an arrow including expanding blades capable of being retracted or expanded as required, in which the expanding blades can be maintained in a retracted state without using an additional means to bundle up the expanding blades during flight of an arrow, and then can quickly and reliably expand only when the arrow hits a target.

According to an aspect of the present invention, there is provided an arrowhead including a main body including a body portion and a protruding portion, wherein the body portion includes a hollow portion therein and one or more expanding blade guide grooves formed on an outer surface thereof, the protruding portion is formed on an upper end of the body portion to be coupled with the penetrating tip, and one or more pressure plate blade guide grooves is formed on an outer surfaces of the body portion and the protruding portion; a pressure plate blade equipped to the protruding portion so as to be movable in a longitudinal direction of the main body along the pressure plate blade guide grooves at a lower side of the penetrating tip; a cylinder being pressed by the pressure plate blade so as to movable in a longitudinal direction of the main body in the hollow portion; and an expanding blade being rotated and expanded from a lower side of the body portion to an upper side thereof according to a movement of the cylinder.

The expanding blade may be rotated and expanded from the lower side of the body portion to the upper side thereof before reaching a target.

A rack gear portion is formed on an outer circumferential surface of the cylinder, and a pinion gear portion engaging with the rack gear portion is formed on a upper end of the expanding blade.

The pinion gear portion has an arc shape on which protrusions and grooves are arranged.

A blade is formed on one side of the expanding blade, and a spur is formed on a lower end of the expanding blade to form a bent angle with respect to the blade. The arrowhead may further include an elastic member which elastically supports a lower end of the cylinder in the main body.

The lower end of the cylinder is supported by the elastic member, and an upper end of the cylinder is supported by the pressure plate blade.

The penetrating tip includes a tip portion provided with a tip edge, and a cylindrical body portion having a screw thread formed on an inner circumferential surface thereof.

According to another aspect of the present invention, there is provided an arrow including the arrowhead and an arrow shaft coupled with a lower end of the arrowhead.

BRIEF DESCRIPTION OF THE DRAWINGS

The above and other objects, features, and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Various embodiments of the present invention will be described herein below with reference to the accompanying drawings. However, these are just exemplary embodiments, and the present invention is not limited thereto.

In the following description, detailed descriptions of well-known functions or constructions will be omitted since they would obscure the invention in unnecessary detail. Also, the terms used herein are defined according to the functions of the present invention. Thus, the terms may vary depending on user's or operator's intentions or practices. Therefore, the terms used herein must be understood based on the descriptions made herein.

Figure 1:
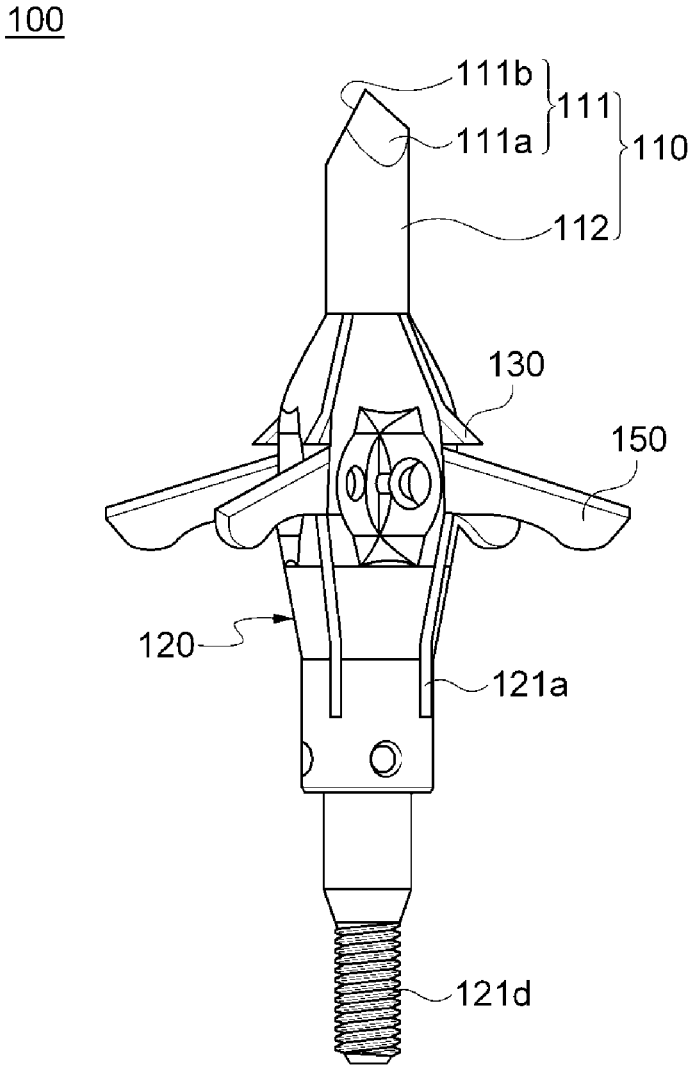
FIG. 1 is a front view of an arrowhead according a first embodiment of the present invention.
Figure 2:
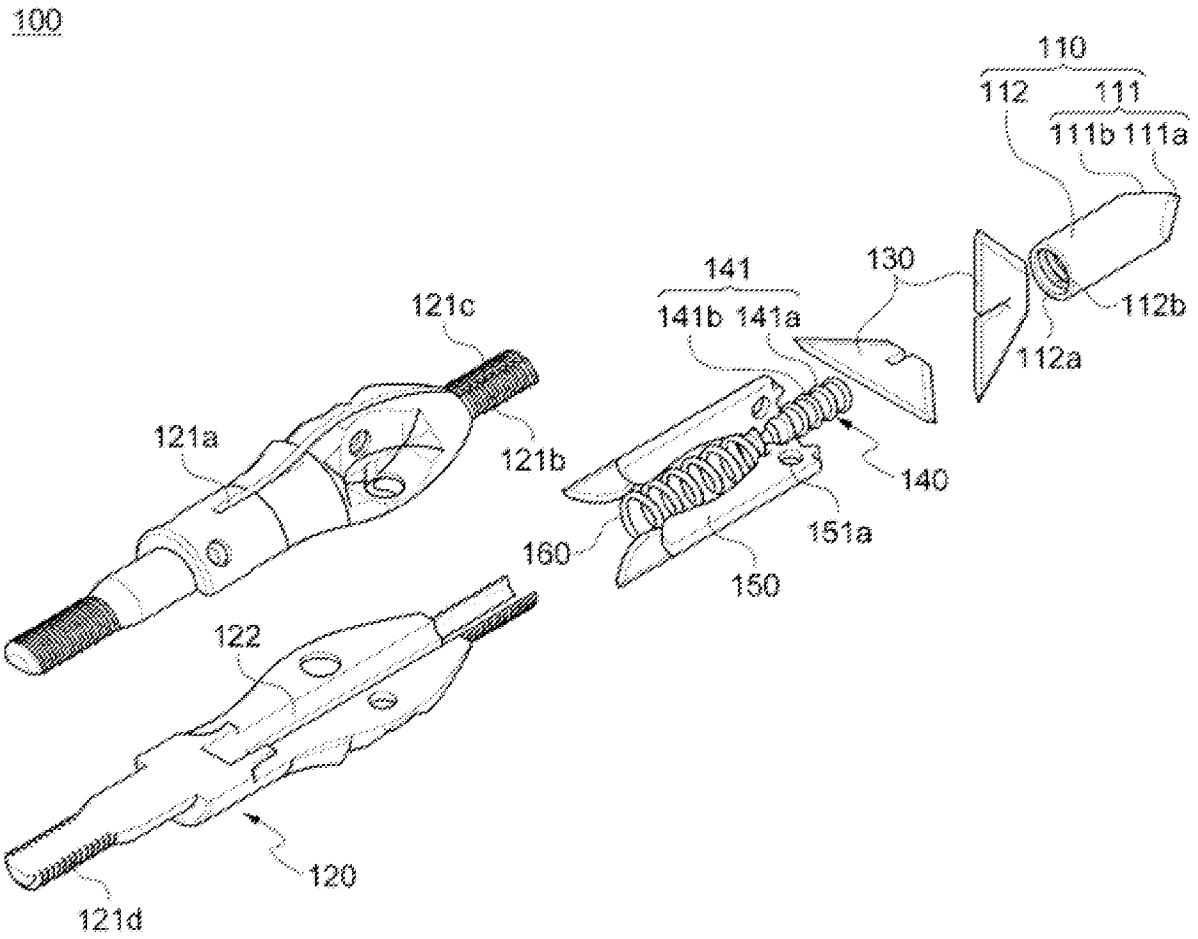
FIG. 2 is an exploded perspective view of the arrowhead according the first embodiment of the present invention.
Figure 3:
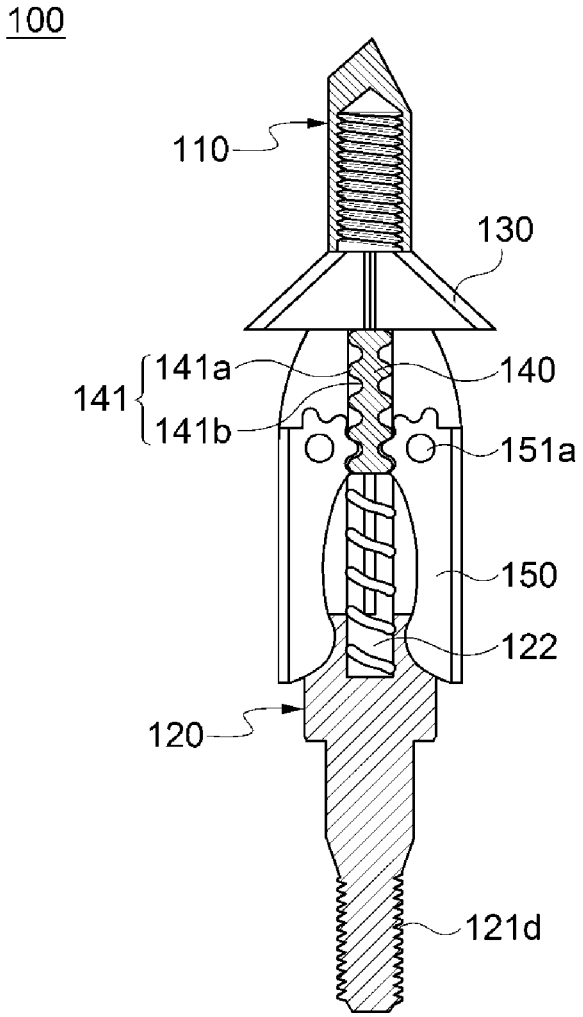
FIG. 3 is a cross-sectional view of the arrowhead according the first embodiment of the present invention.

FIG. 1 is a front view of an arrowhead according a first embodiment of the present invention, FIG. 2 is an exploded perspective view of the arrowhead according the first embodiment of the present invention, and FIG. 3 is a cross-sectional view of the arrowhead according the first embodiment of the present invention. As illustrated in FIGS. 1 to 3, an arrowhead 100 according to a first embodiment of the present invention includes a penetrating tip 110, a main body 120, a pressure plate blade 130, a cylinder 140, expanding blades 150, and an elastic member 160.

The penetrating tip 110 serves to firstly penetrate a target when an arrow hits the target. The penetrating tip 110 includes a sharpened upper end. Here, the target may be, for example, game such as an animal. For example, the penetrating tip 110 may be formed so that the upper end thereof is sharpened and a diameter thereof is gradually increased toward a lower end thereof and then maintained uniformly. The penetrating tip 110 may include a tip portion 111 disposed at the upper end thereof and a body portion 112 disposed at the lower end thereof.

The tip portion 111 may include a flat tip surface 111*a* and a tip edge 111*b* which is a sharp edge. Since the tip surface 111*a* and the tip edge 111*b* are formed on the tip portion 111, it is possible to additionally secure a pointed portion (or a sharp portion) at the tip portion 111 which penetrates the target. Therefore, when the penetrating tip 110 penetrates the target, it is possible to effectively and easily penetrated the target and also induce excessive bleeding of the target. Here, in the drawing, two tip surfaces 111*a* are provided at the tip portion 111. However, the number of the tip surfaces 111*a* is not limited thereto, and three or four or more tip surfaces 111*a* may be provided at the tip portion 111.

The body portion 112 may include a hollow portion 112*a* that a screw thread 112*b* is formed on an inner surface thereof. The body portion 112 may be formed to have a uniform diameter and to be extended downwardly (namely, to the longitudinal direction thereof). However, a shape of the body portion 112 is not limited thereto, and the body portion 112 may be formed to have a diameter which is gradually increased toward a lower side thereof, and the tip surfaces and the tip edges may be formed to an outer surface of the body portion 112, like in the tip portion 111. The body portion 112 may include a hollow portion 112*a* formed therein, and the screw thread 112*b* may be formed on an inner circumferential surface of the body portion 112. Forming of the screw thread 112*b* is to couple the main body 120 and the penetrating tip 110. A coupling manner of the main body 120 and the penetrating tip 110 may be the same as that of a protruding portion 121*b* of the main body 120 and the screw thread 112*b*, which will be described later, but is not limited thereto. For example, the hollow portion 112*a* of the body portion 112 may have a polygonal shape, and the protruding portion 121*b* of the main body 120 may have a corresponding shape, and the protruding portion 121*b* may be inserted into the hollow portion 112*a* of the body portion 112 and then fastened thereto by a separate fastening means (a groove-protrusion coupling).

The pressure plate blade 130 may be in close contact with a lower end of the body portion 112. A groove having a predetermined size may be formed on the lower end of the body portion 112 so that an upper end (a lower end of the penetrating tip 110) of the pressure plate blade 130 is fitted to the lower end of the body portion 112. Furthermore, a closely contacting manner between the body portion 112 and the pressure plate blade 130 may be provided variously. For example, although not illustrated, a fitting portion having a narrow neck portion may be provided at the upper end of the pressure plate blade 130 and then inserted into the hollow portion 112*a* of the body portion 112 to be in close contact therewith. Meanwhile, as the penetrating tip 110 reaches and gradually penetrates into the target, the pressure plate blade 130 which is in close contact with the lower end of the body portion 112 may be in contact with a surface of the target. Then, if the arrowhead 100 further penetrates into the target, the pressure plate blade 130 may be pushed downwardly (in an opposite direction to a fight direction of the penetrating tip 110) and separated from the lower end of the body portion 112.

The main body 120 forming a body part of the arrowhead 100 includes a hollow portion 122 defined therein, and also includes the cylinder 140, the expanding blades 150, and the elastic member 160 disposed therein. Further, the main body 120 includes a body portion 121 having a plurality of expanding blade guide grooves 121*a* formed on an outer surface thereof. The plurality of expanding blade guide grooves 121*a* (the expression "groove" includes a type of slot.) may be extended in a longitudinal direction of the main body 120. Also, the plurality of expanding blade guide grooves 121*a* may have a length which corresponds to or is longer than that of the plurality of expanding blades 150. The plurality of expanding blades 150 may be retracted inside or expanded outside the main body 120 through the plurality of expanding blade guide grooves 121*a*. In a state in which the expanding blades 150 are retracted, outer parts of the expanding blades 150 may partially protrude outside the main body 120 or may be completely inserted inside the main body 120. In the drawings, four expanding blade guide grooves 121*a* are respectively formed on the outer surface of the main body 120 so as to correspond to each position of the expanding blades 150 and to be spaced apart from each other at regular intervals. However, the number of the expanding blade guide grooves 121*a* is not limited thereto, and two, three, or five or more expanding blade guide grooves 121*a* may be formed on the outer surface of the main body 120. The number of the expanding blade guide grooves 121*a* may be more than or the same as that of the expanding blades 150.

The hollow portion 122 may be formed in the body portion 121 to be extended in the longitudinal direction of the main body 120, and may have a cylindrical shape. The cylinder 140 and the elastic member 160 may be located in the hollow portion 122. Thus, the hollow portion 122 may have a larger diameter than the cylinder 140 and the elastic member 160. As described later, the cylinder 140 may be moved in the hollow portion 122 being pressed by the pressure plate blade 130.

The protruding portion 121*b* coupled with the penetrating tip 110 is formed on an upper end of the main body 120. The protruding portion 121*b* may have, for example, a cut-off bolt shape. One or more pressure plate blade guide grooves 121*c* (the expression "groove" includes a type of slot.) may be formed on outer surfaces of the protruding portion 121*b* and the body portion 121. In the drawings, the expanding blade guide grooves 121*a* are extended from the pressure plate blade guide grooves 121*c*. However, the present invention is not limited thereto, and the pressure plate blade guide grooves 121*c* and the expanding blade guide grooves 121*a* may be separately formed and then coupled with each other (e.g., by a welding or the like). The pressure plate blade 130 may be equipped to the protruding portion 121*b* to be movable in a longitudinal direction thereof, and may be moved up and down along the pressure plate blade guide grooves 121*c* and the expanding blade guide grooves 121*a* in the longitudinal direction of the main body 120 at a lower side of the penetrating tip 110. When the pressure plate blade 130 is moved toward a lower side of the main body 120 along the pressure plate blade guide grooves 121*c* and the expanding blade guide grooves 121*a*, the pressure plate blade 130 may be separated and spaced apart from the lower end of the body portion 112 of the penetrating tip 110.

The elastic member 160 may be provided in the main body 120 so as to support a lower end of the cylinder 140. As described above, the elastic member 160 may be located in the hollow portion 122 of the main body 120. For example, the elastic member 160 may be a spring. The lower end of the cylinder 140 may be supported by the elastic member 160, and an upper end thereof may be supported by the pressure plate blade 130. As described later, the cylinder 140 may be moved toward the lower side of the main body 120 being pressed by the pressure plate blade 130. When the cylinder 140 is moved toward the lower side of the main body 120 with the pressure plate blade 130, the cylinder 140 presses the elastic member 160, and the elastic member 160 is compressed. Meanwhile, it was described that the cylinder 140 was separately provided from the pressure plate blade 130. However, the cylinder 140 may be integrally formed with the pressure plate blade 130.

Further, the plurality of expanding blades 150 are hingedly coupled in one side of the main body 120. A downward movement of the cylinder 140 may results in rotation of the expanding blades 150. To this end, as described later, a pinion gear portion 154 may be formed on an upper end (the side of the penetrating tip 110) of each of the expanding blades 150, and the pinion gear portion 154 engages with a rack gear portion 141 formed on an outer circumferential surface of the cylinder 140. The expanding blades 150 may be retracted and expanded by a gear operation between the rack gear portion 141 and the pinion gear portion 154 according to upward and downward movements of the pressure plate blade 130 and the cylinder 140. Meanwhile, a thread portion 121*d* coupled with an arrow shaft 310 may be formed on a lower end of the main body 120.

The pressure plate blade 130 serves to induce excessive bleeding of a target and also to press the cylinder 140 disposed in the main body 120. The pressure plate blade 130 may be formed by a combination of one or more plates. As illustrated in the drawings, each plate of the pressure plate blade 130 may have a groove which is defined in a faced side with each other to have a predetermined size, and thus, by the grooves being coupled with each other, the plates may be interlocked with each other. However, a structure of the pressure plate blade 130 is not limited thereto, and the pressure plate blade 130 may be formed into a single structure. Further, the pressure plate blade 130 may include a sharp side edge so as to induce the bleeding of the target. For example, the side edge of the pressure plate blade 130 may have a blade shape for inducing bleeding and penetrating of the target.

The pressure plate blade 130 may be moved up and down along the pressure plate blade guide grooves 121*c* and the expanding blade guide grooves 121*a* in the longitudinal direction of the main body 120. If a cross section of the pressure plate blade 130 has a cross shape, it is necessary to form four or more pressure plate blade guide grooves 121*c* in the protruding portion 121*b* in order to guide the pressure plate blade 130. Further, as illustrated in the drawings, the pressure plate blade guide grooves 121*c* and the expanding blade guide grooves 121*a* may be formed to be extended from each other. Also, the expanding blade guide grooves 121*a* may be formed to correspond to the cross section of the pressure plate blade 130. However, each shape of the pressure plate blade 130, the pressure plate blade guide grooves 121*c*, and the expanding blade guide grooves 121*a*, as described above, is only an embodiment, and may be modified variously.

Before penetrating the target, the upper end of the pressure plate blade 130 may be supported by and in close contacted with the lower end of the penetrating tip 110, i.e., the lower end of the body portion 112, and the lower end of the pressure plate blade 130 may be supported by and in close contacted with an upper end of the cylinder 140. Further, the lower end of the cylinder 140 may be supported by and in close contacted with an upper end of the elastic member 160. In this case, the elastic member 160 may be in a released state. As the penetrating tip 110 penetrates the target, the pressure plate blade 130 pressed by the target may be moved toward the lower side of the main body 120 along the pressure plate blade guide grooves 121*c* and the expanding blade guide grooves 121*a*, and the pressure plate blade 130 may be separated from the lower end of the body portion 112 of the penetrating tip 110. The cylinder 140 may be moved toward the lower side of the main body 120 being pressed by the pressure plate blade 130. In this process, the cylinder 140 presses the elastic member 160, and then the elastic member 160 is compressed.

The cylinder 140 serves to be moved in the longitudinal direction of the main body 120 being pressed by the pressure plate blade 130 and thereby to induce the rotation of the expanding blades 150. The cylinder 140 may have the cylindrical shape. The rack gear portion 141 may include protrusions 141*a* and grooves 141*b*. The rack gear portion 141 is formed on the outer circumferential surface of the cylinder 140. The rack gear portion 141 may engage with the pinion gear portion 154 of each of the expanding blades 150. As described above, the upper end of the cylinder 140 is supported by the pressure plate blade 130, and the lower end thereof is supported by the elastic member 160.

The expanding blades 150 are maintained in a retracted state before the arrowhead 100 hits the target, and then expanded at the same time when the arrowhead 100 hits the target, thereby inducing the excessive bleeding of the target.

Figure 4:
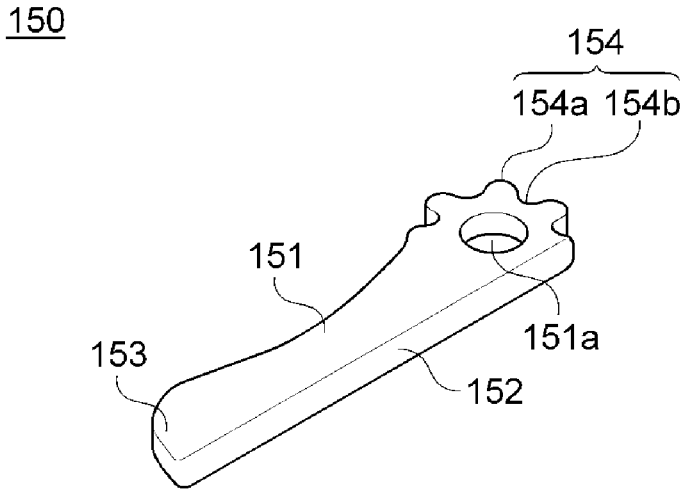
FIG. 4 is a perspective view illustrating an external appearance of expanding blades according the first embodiment of the present invention.

FIG. 4 is a perspective view illustrating an external appearance of the expanding blades 150 according the first embodiment of the present invention. As illustrated in FIG. 4, the expanding blades 150 includes a body portion 151, a blade 152 formed on one side of the body portion 151, a spur 153 formed on a lower end of the body portion 151 to be bent or curved, and the pinion gear portion 154 formed on an upper end of the body portion 151. The body portion 151 includes a hinge shaft coupling hole 151*a* formed to pass through the body portion 151.

The pinion gear portion 154 is formed by arranging protrusions 154*a* and grooves 154*b* on an arc-shaped end having a semicircular shape, and engages with the rack gear portion 141 of the cylinder 140. When the expanding blades 150 are retracted, the elastic member 160 is not compressed, and the pinion gear portion 154 of each of the expanding blades 150 engages with a lower end of the rack gear portion 141 of the cylinder 140. When the cylinder 140 is moved toward the lower side of the main body 120 being pressed by the pressure plate blade 130, the pinion gear portion 154 of each of the expanding blades 150 engaging with the lower end of the rack gear portion 141 of the cylinder 140 is rotated upwardly, and thus the expanding blades 150 are expanded. A shape of the pinion gear portion 154 as described above is only one embodiment, and it would be obvious to a person skilled in the art to enable the pinion gear portion 154 to have various other shapes. Further, it was described that the rotation and the expansion of the expanding blades 150 was caused by the gear operation between the rack gear portion 141 and the pinion gear portion 154. But this is only an embodiment and is not limited. The rotation and the expansion of the expanding blade 150 may be caused through various manners such as a cam operation, as well as the gear operation.

Figure 5A:
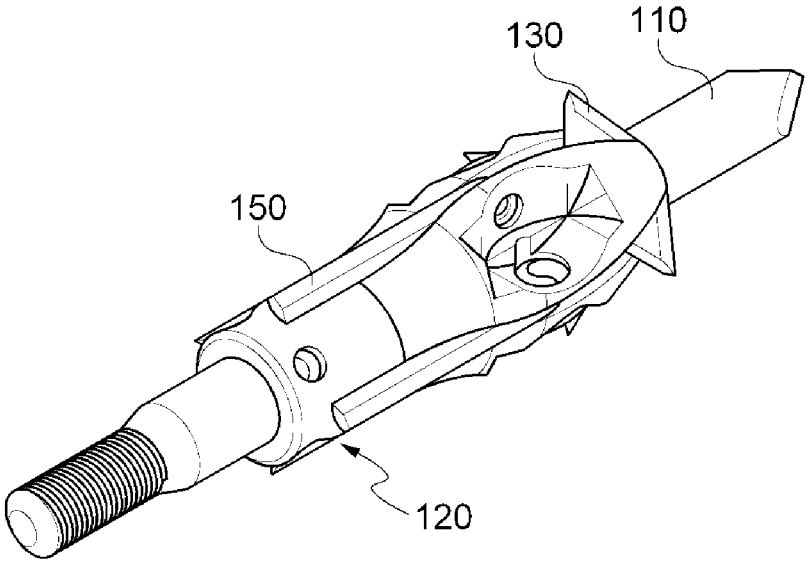
FIG. 5A is a perspective view illustrating an external appearance of the arrowhead in a state in which the expanding blades are retracted according the first embodiment of the present invention.
Figure 5B:
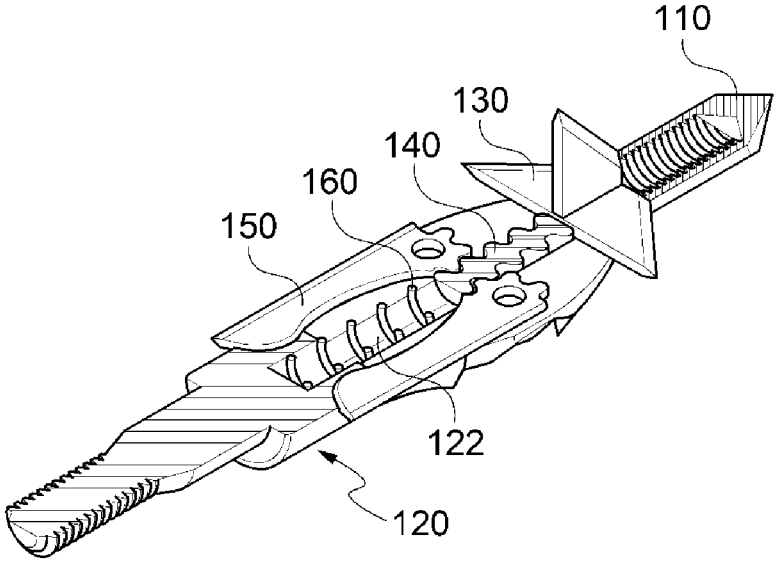
FIG. 5B is a cross-sectional view of the arrowhead in the state in which the expanding blades are retracted according the first embodiment of the present invention.
Figure 6A:
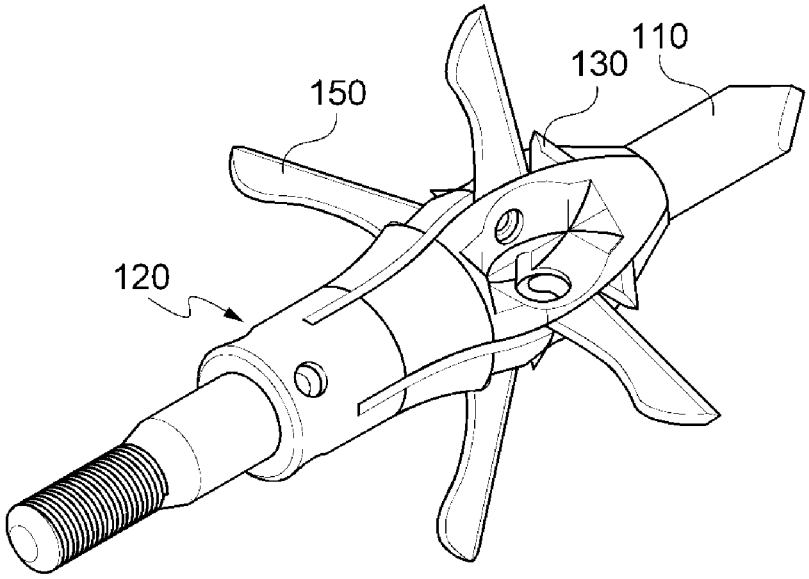
FIG. 6A is a perspective view illustrating an external appearance of the arrowhead in a state in which the expanding blades are expanded according the first embodiment of the present invention.
Figure 6B:
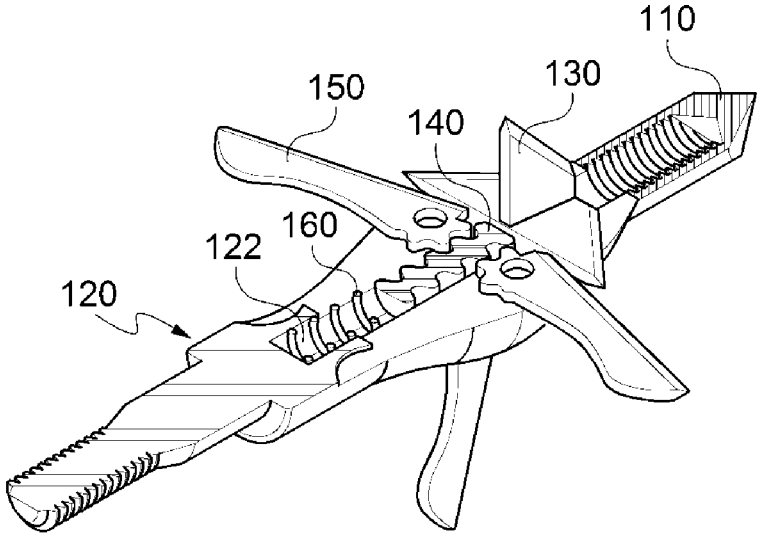
FIG. 6B is a cross-sectional view of the arrowhead in the state in which the expanding blades are expanded according the first embodiment of the present invention.

FIGS. 5A and 5B are a perspective view and a cross-sectional view illustrating an external appearance of the arrowhead 100 in the state in which the expanding blades 150 are retracted according the first embodiment of the present invention, and FIGS. 6A and 6B are a perspective view and a cross-sectional view illustrating an external appearance of the arrowhead 100 in the state in which the expanding blades 150 are expanded according the first embodiment of the present invention. In the arrowhead 100 according the first embodiment of the present invention, as illustrated in FIGS. 5A and 5B, the plurality of expanding blades 150 are maintained in the retracted state before the arrow is shot. And as illustrated in FIGS. 6A and 6B, when the arrow is shot and hits the target, the plurality of expanding blades 150 are rotated upwardly and expanded.

More specifically, as illustrated in FIGS. 5A and 5B, when the plurality of expanding blades 150 are retracted, the elastic member 160 is not compressed, and the pinion gear portion 154 of each of the expanding blades 150 engages with the lower end of the rack gear portion 141 of the cylinder 140.

When the arrow is shot and hits the target, the penetrating tip 110 penetrates leather or skin of game as the target. At this time, the pressure plate blade 130 is pushed back toward the lower side of the main body 120 by the target. Therefore, as illustrated in FIGS. 6A and 6B, the pressure plate blade 130 is moved toward the lower side of the main body 120 along the pressure plate blade guide grooves 121*c* and the expanding blade guide grooves 121*a*. The pressure plate blade 130 presses the cylinder 140, while being moved toward the lower side of the main body 120, and the cylinder 140 is moved toward the lower side of the main body 120 being pressed by the pressure plate blade 130. In this process, the cylinder 140 presses the elastic member 160, and the elastic member 160 is compressed.

While the cylinder 140 is moved downwardly in the main body 120, the pinion gear portion 154 of each of the expanding blades 150 engaging with the lower end of the rack gear portion 141 is rotated and the expanding blades 150 are expanded. That is, the rack gear portion 141 rotates the pinion gear portion 154, while being moved toward the lower side of the main body 120, and thus the expanding blades 150 are rotated on a hinge axis (not shown).

In the arrowhead 100 according to the first embodiment of the present invention, as described above, since the expanding blades 150 engages with the rack gear portion 141, the expanding blades 150 are stably maintained in the retracted state during flight of the arrow in which no particular impact is applied, and then expanded at the same time when hitting the target. That is, since the expanding blades 150 are expanded at the entrance of the target at the same when the arrowhead 100 hits the target, the expanding blades 150 are prevented from being expanded unexpectedly during flight. Also, since the plurality of expanding blades 150 penetrate the target in an expanded state, it is possible to induce the excessive bleeding of the target and thus quickly snuff out the target.

Figure 7:
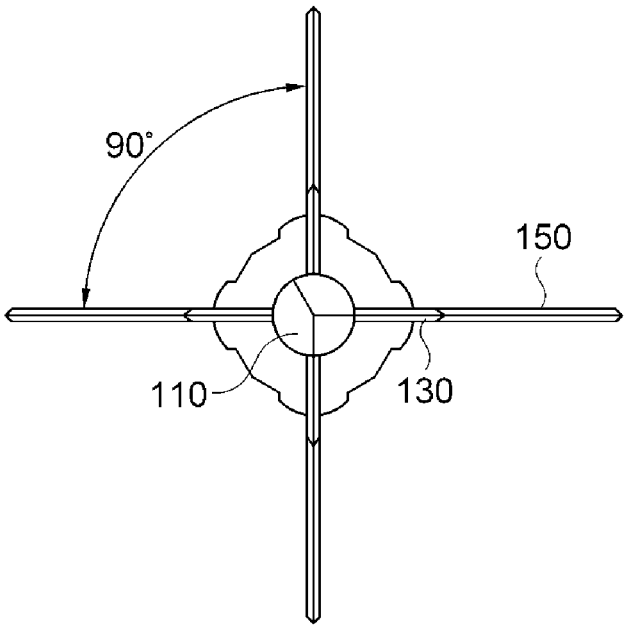
FIG. 7 is a plan view of a pressure plate blade and the expanding blades in the state in which the expanding blades are expanded according the first embodiment of the present invention.

FIG. 7 is a plan view of the pressure plate blade 130 and the expanding blades 150 in the state in which the expanding blades 150 are expanded according the first embodiment of the present invention. As illustrated in FIG. 7, in the state in which the expanding blades 150 are expanded according the first embodiment of the present invention, four expanding blades 150 form an angle of 90° with respect to each other and has a cross shape. Further, the cross section of the pressure plate blade 130 may have the cross shape, and an angle between the pressure plate blade 130 and the expanding blades 150 may be 0°. However, this is only an embodiment, and if necessary, the number of the expanding blades 150 may be 2 to 4 or more. In this case, an angle between the expanding blades 150 may be changed. Also, in the first embodiment of the present invention, it was illustrated that the pressure plate blade 130 was formed by vertically cross-coupling two trapezoidal plates to have the cross shape in section, but the pressure plate blade 130 is not limited thereto. The pressure plate blade 130 may be formed into a single plate and also may have various shapes other than the cross shape.

Figure 8:
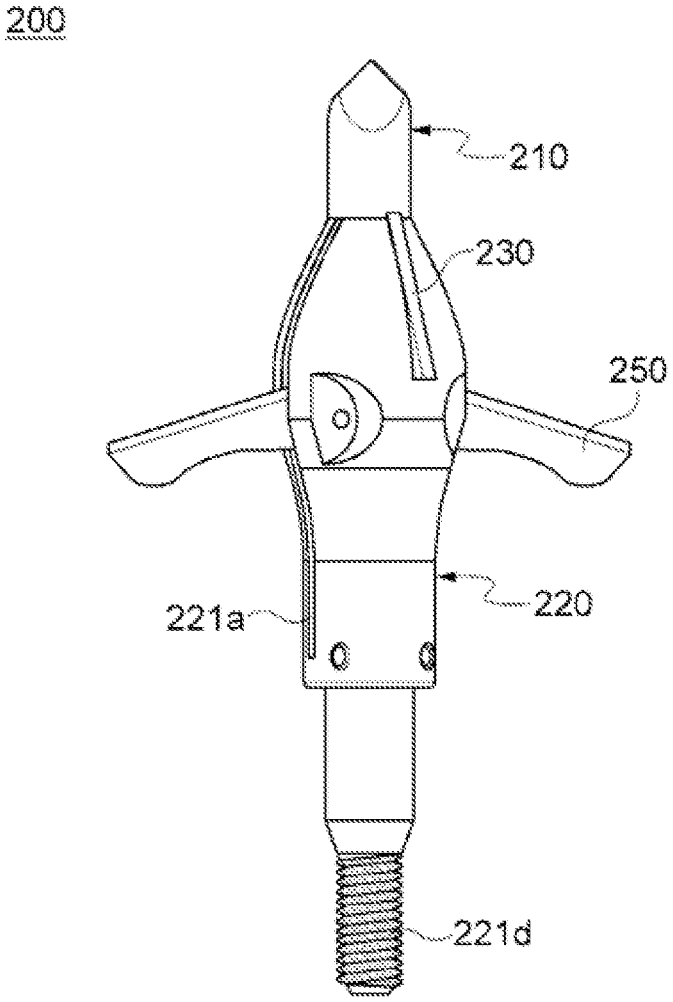
FIG. 8 is a front view of an arrowhead according to a second embodiment of the present invention.
Figure 9:
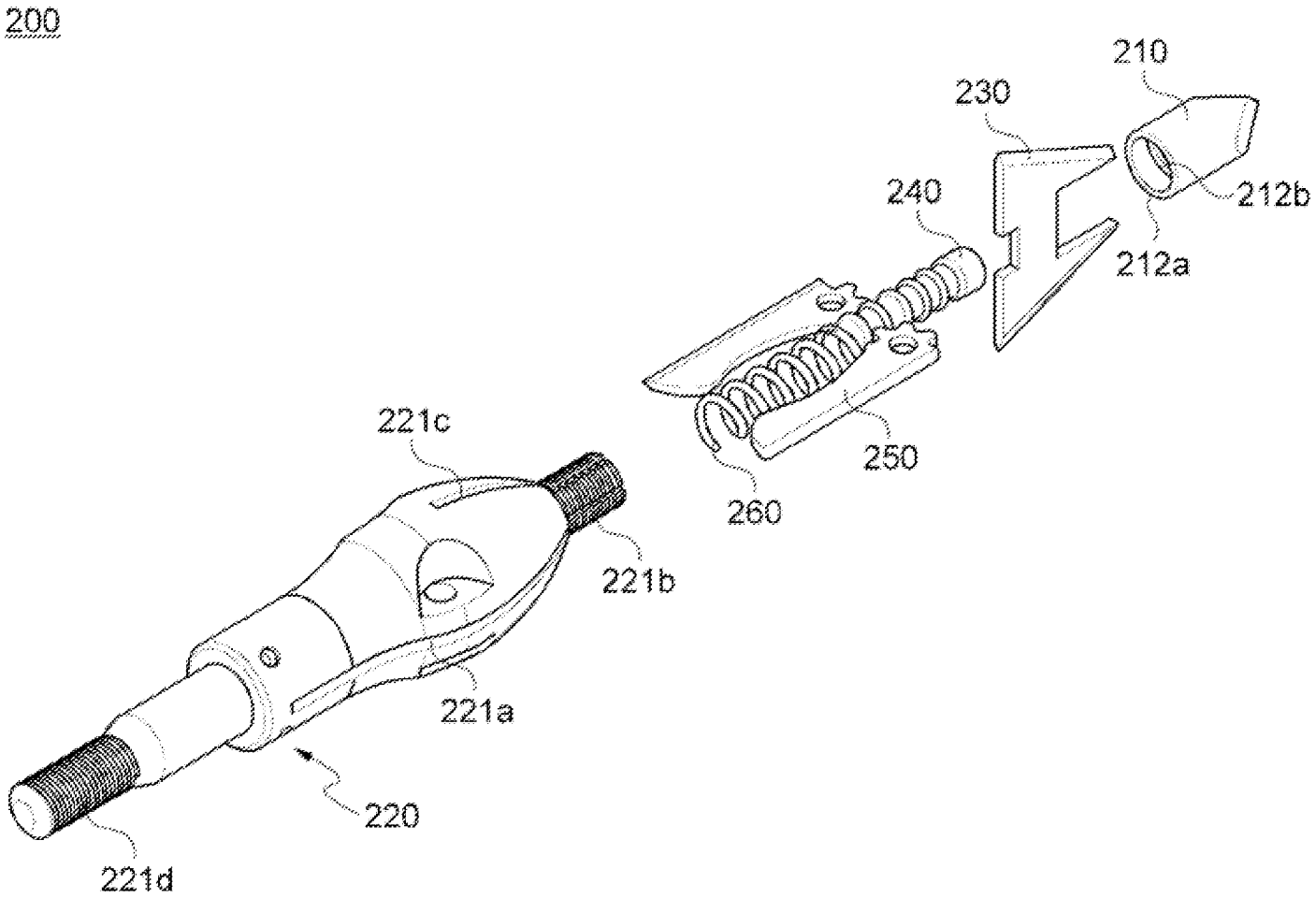
FIG. 9 is an exploded perspective view of the arrowhead according to the second embodiment of the present invention.

FIG. 8 is a front view of an arrowhead 200 according to a second embodiment of the present invention, and FIG. 9 is an exploded perspective view of the arrowhead 200 according to the second embodiment of the present invention. As illustrate in FIGS. 8 and 9, an arrowhead 200 according to a second embodiment of the present invention includes a penetrating tip 210, a main body 220, a pressure plate blade 230, a cylinder 240, expanding blades 250, and an elastic member 260. Since the penetrating tip 210, the cylinder 240, and the elastic member 260 according to the second embodiment of the present invention are the same as those in the first embodiment, detailed description thereof will be omitted.

The main body 220 according to the second embodiment of the present invention includes a body portion 221. The body portion 221 may include a hollow portion 222 formed therein. The body portion 221 may include a plurality of expanding blade guide grooves 221*a* and a plurality of pressure plate blade guide grooves 221*c* formed on an outer surface thereof. The plurality of expanding blade guide grooves 221*a* and the plurality of pressure plate blade guide grooves 221*c* may be respectively formed to be extended in a longitudinal direction of the main body 220. A protruding portion 221*b* coupled with the penetrating tip 210 is formed on an upper end of the main body 220. The pressure plate blade guide grooves 221*c* are formed to be extended in a longitudinal direction of the main body 220 on outer surfaces of the main body 220 and the protruding portion 221*b*. The plurality of expanding blades 250 may be retracted inside or expanded outside the main body 220 through the expanding blade guide grooves 221*a*, and the plurality of pressure plate blades 230 may be moved in the longitudinal direction of the main body along the pressure plate blade guide grooves 221*c*.

The pressure plate blade 230 according to the second embodiment of the present invention may be formed into a single trapezoidal plate. A groove having a predetermined size may be formed on an upper end of the pressure plate blade 230 so that a part of a lower end of the penetrating tip 210 may be inserted therein, and another groove having a predetermined size may be formed on a lower end thereof so that a part of an upper end of the cylinder 240 may be inserted therein. Therefore, the penetrating tip 210, the pressure plate blade 230, and the cylinder 240 may be strongly in close contact with each other. According to the second embodiment of the present invention, two expanding blades 250 may be expanded at an angle of 180°.

Figure 10A:
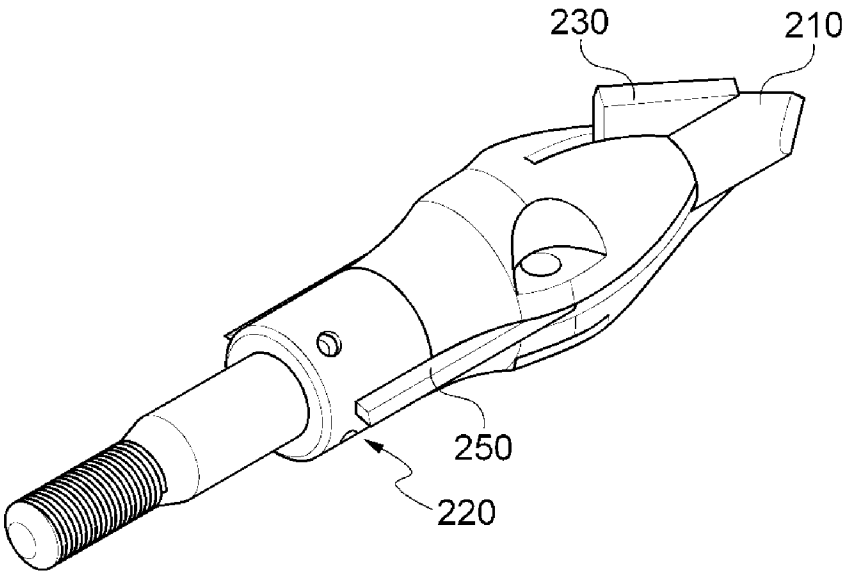
FIG. 10A is a perspective view illustrating an external appearance of the arrowhead in a state in which expanding blades are retracted according to the second embodiment of the present invention.
Figure 10B:
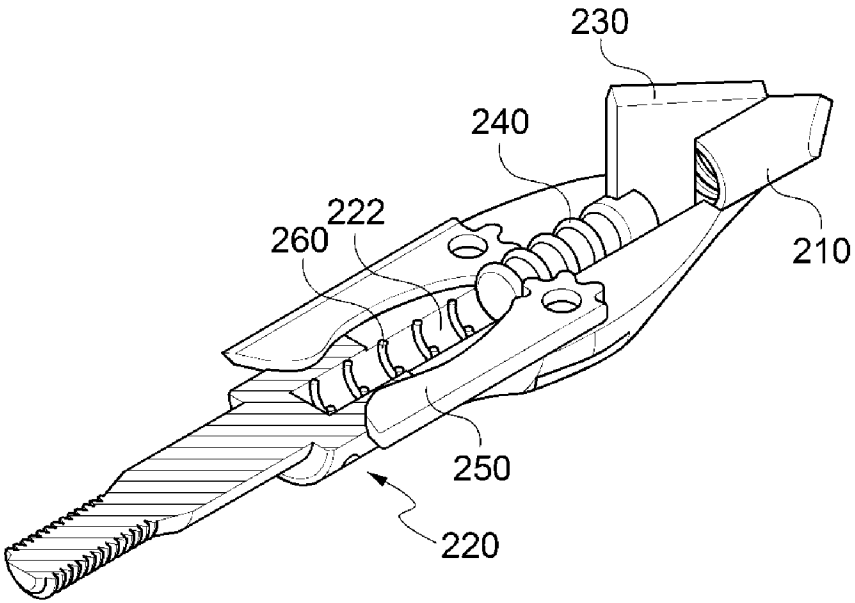
FIG. 10B is a cross-sectional view of the arrowhead in the state in which the expanding blades are retracted according to the second embodiment of the present invention.
Figure 11A:
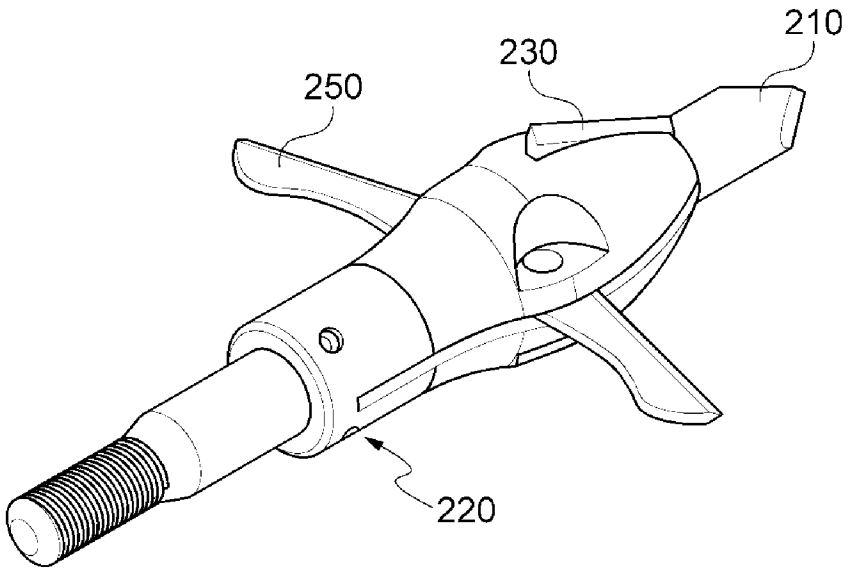
FIG. 11A is a perspective view illustrating an external appearance of the arrowhead in a state in which the expanding blades are expanded according to the second embodiment of the present invention.
Figure 11B:
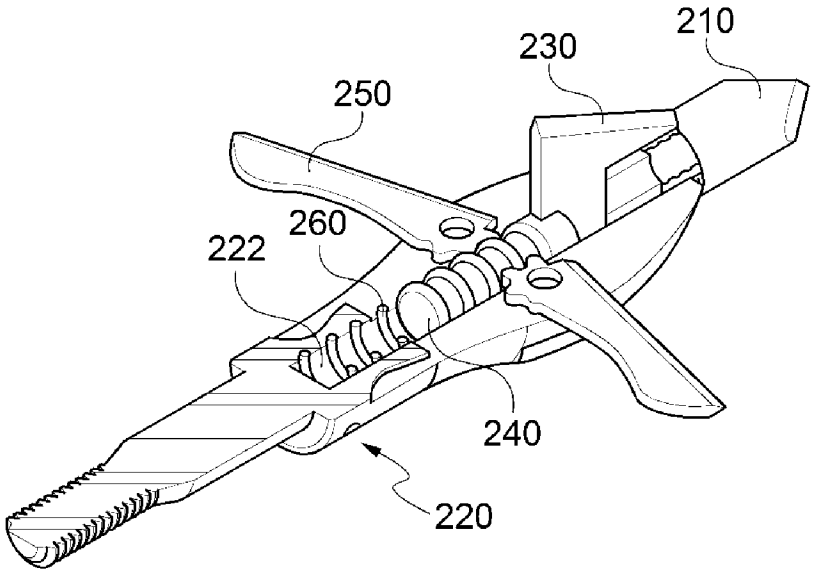
FIG. 11B is a cross-sectional view of the arrowhead in the state in which the expanding blades are expanded according to the second embodiment of the present invention.

FIGS. 10A and 10B are a perspective view and a cross-sectional view illustrating an external appearance of the arrowhead 200 in a state in which the expanding blades 250 are retracted according to the second embodiment of the present invention, and FIGS. 11A and 11B are a perspective view and a cross-sectional view illustrating an external appearance of the arrowhead 200 in a state in which the expanding blades 250 are expanded according to the second embodiment of the present invention. In the arrowhead 200 according the second embodiment of the present invention, as illustrated in FIGS. 10A and 10B, the plurality of expanding blades 250 are maintained in a retracted state before the arrow is shot. And as illustrated in FIGS. 11A and 11B, when the arrow is shot and hits the target, the plurality of expanding blades 250 are rotated upwardly and expanded. Since an operation of the arrowhead 200 is the same as that in the first embodiment, detailed description thereof will be omitted.

Figure 12:
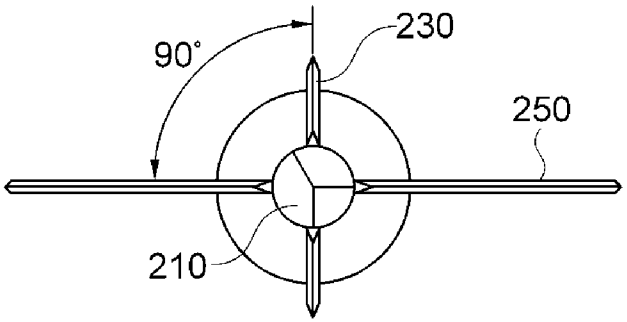
FIG. 12 is a plan view of a pressure plate blade and the expanding blades in the state in which the expanding blades are expanded according the second embodiment of the present invention.

FIG. 12 is a plan view of the pressure plate blade 230 and the expanding blades 250 in the state in which the expanding blades 250 are expanded according the second embodiment of the present invention. As illustrated in FIG. 12, in the state in which expanding blades 250 are expanded according the second embodiment of the present invention, two expanding blades 250 form an angle of 180° with respect to each other and may have a straight-line shape in section. Also, the pressure plate blade 230 may have a straight-line shape in section, and may be perpendicular to the expanding blades 250. However, as described above, the number of the expanding blades 250 and the shape of the pressure plate blade 230 may be changed, if necessary.

Figure 13:
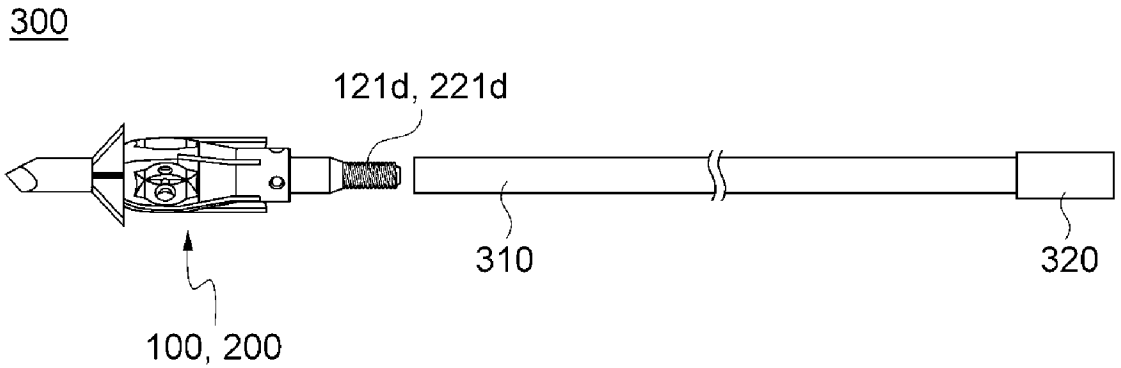
FIG. 13 is a view illustrating an arrow according to one embodiment of the present invention.

FIG. 13 is a view illustrating an arrow 300 according to one embodiment of the present invention. The arrow 300 according to one embodiment of the present invention includes the above-mentioned arrowhead 100 or 200 and an arrow shaft 310 coupled with the arrowhead 100 or 200. The arrow shaft 310 forming a body of the arrow 300 may be coupled with the lower end of the arrowhead 100 or 200, and may include a screw thread (not shown) formed on an inner circumferential surface thereof. The screw thread may be coupled with the thread portion 121*d* or 221*d* formed on the lower end of the arrowhead 100 or 200. The arrow shaft 310 may be extended in a longitudinal direction of the main body 220 in a predetermined length and may be coupled with an nock 320 of the arrow 300. Since the configuration of the arrowhead 100 or 200 is already described fully, description thereof will be omitted.

According to the embodiments of the present invention, the arrowhead and the arrow having the plurality of expanding blades which may be retracted and expanded as needed are provided. Although not using a separate means for binding the expanding blades, the expanding blades are maintained in the retracted state during flight of the arrow, and then expanded quickly and reliably only when the arrow hits the target.

Further, according to the embodiments of the present invention, the expanding blades are configured to be expanded at an entrance of the target at the same time when the arrowhead hits the target, and thus the arrow may penetrate the target in the state in which the expanding blades are expanded. Therefore, the contacting surface between the expanding blades and the target is increased, and thus it is possible to induce excessive bleeding of the target and thus quickly snuff out the target.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. An arrowhead comprising:

a penetrating tip including a sharpened upper end;

a main body comprising a body portion and a protruding portion, the body portion including a hollow portion therein and one or more expanding blade guide grooves formed on an outer surface thereof, the protruding portion formed on an upper end of the body portion to be coupled with the penetrating tip, one or more pressure plate blade guide grooves formed on an outer surfaces of the body portion and the protruding portion;

a pressure plate blade equipped to the protruding portion, the pressure plate blade being movable in a longitudinal direction of the main body along the pressure plate blade guide grooves at a lower side of the penetrating tip;

a cylinder being pressed by the pressure plate blade so as to be movable in a longitudinal direction of the main body in the hollow portion; and an expanding blade being rotated and expanded from a lower side of the body portion to an upper side thereof according to a movement of the cylinder.

2. The arrowhead of claim 1, wherein the expanding blade is rotated and expanded from the lower side of the body portion to the upper side thereof before reaching a target.

3. The arrowhead of claim 1, wherein a rack gear portion is formed on an outer circumferential surface of the cylinder, and a pinion gear portion engaging with the rack gear portion is formed on a upper end of the expanding blade.

4. The arrowhead of claim 3, wherein the pinion gear portion has an arc shape on which protrusions and grooves are arranged.

5. The arrowhead of claim 1, wherein a blade is formed on one side of the expanding blade, and a spur is formed on a lower end of the expanding blade to form a bent angle with respect to the blade.

6. The arrowhead of claim 1, further comprising an elastic member which elastically supports a lower end of the cylinder in the main body.

7. The arrowhead of claim 6, wherein the lower end of the cylinder is supported by the elastic member, and an upper end of the cylinder is supported by the pressure plate blade.

8. The arrowhead of claim 1, wherein the penetrating tip includes a tip portion provided with a tip edge, and a cylindrical body portion having a screw thread formed on an inner circumferential surface thereof.

9. An arrow comprising:

an arrowhead of claim 1; and an arrow shaft coupled with a lower end of the arrowhead.

* * * * *